US012680762B2

(12) United States Patent
Ali et al.

(10) Patent No.: US 12,680,762 B2
(45) Date of Patent: Jul. 14, 2026

(54) VAPOR CHAMBER SUPPORTING CAPILLARY STRUCTURE

(71) Applicant: NIDEC CHAUN-CHOUNG TECHNOLOGY CORPORATION, New Taipei City (TW)

(72) Inventors: Abbas Ali, New Taipei City (TW); Jheng-Yan Wang, New Taipei City (TW); Shao-Chien Lu, New Taipei City (TW)

(73) Assignee: NIDEC CHAUN-CHOUNG TECHNOLOGY CORPORATION, New Taipei City (TW)

( * ) Notice: Subject to any disclaimer, the term of this patent is extended or adjusted under 35 U.S.C. 154(b) by 108 days.

(21) Appl. No.: 18/229,986

(22) Filed: Aug. 3, 2023

(65) Prior Publication Data

US 2025/0044038 A1 Feb. 6, 2025

(51) Int. Cl.
*F28D 15/04* (2006.01)

(52) U.S. Cl.
CPC ..... *F28D 15/04* (2013.01)

(58) Field of Classification Search
CPC ..... F28D 15/04; F28D 15/046; H01L 23/427; H05K 7/20336; F28F 3/12; F28F 3/044
See application file for complete search history.

(56) References Cited

U.S. PATENT DOCUMENTS

2007/0295486 A1* 12/2007 Su ..... F28D 15/046 165/104.26
2015/0114603 A1* 4/2015 Pai ..... H05K 7/20336 165/104.26
2018/0320997 A1* 11/2018 He ..... F28D 15/0283
(Continued)

FOREIGN PATENT DOCUMENTS

CN 110418550 A 11/2019
CN 110657696 A * 1/2020 ..... F28D 15/0266
CN 213578887 U 6/2021
(Continued)

OTHER PUBLICATIONS

English translation of CN 110657696A (Year: 2020).*
Office Action dated Feb. 18, 2025 of the corresponding Taiwan patent application No. 112124160.

*Primary Examiner* — Tho V Duong
(74) *Attorney, Agent, or Firm* — HDLS IPR SERVICES; Chun-Ming Shih

(57) ABSTRACT

A vapor chamber supporting capillary structure includes a first plate, a second plate and a capillary layer. The capillary layer is clamped between the first plate and the second plate and includes a first capillary portion and a second capillary portion. The second capillary portion is connected to the first capillary portion and extends outward, and a notch is formed at any one side of the second capillary portion. The notch is formed along an extension direction of the second capillary portion. Furthermore, the first plate includes a plurality of capillary supporting structures and a plurality of plate supporting structures formed thereon, and the capillary supporting structures are corresponding to the first capillary portion and the second capillary portion, and the plate supporting structures are corresponding to the notch. Accordingly, a greater steam space may be obtained.

6 Claims, 6 Drawing Sheets

(56) References Cited

U.S. PATENT DOCUMENTS

| | | | | |
|---|---|---|---|---|
| 2020/0049420 | A1* | 2/2020 | Liu | F28D 15/04 |
| 2023/0123190 | A1* | 4/2023 | Lin | F28D 15/046 165/104.26 |

FOREIGN PATENT DOCUMENTS

| | | | | | |
|---|---|---|---|---|---|
| CN | 217818301 | U | | 11/2022 | |
| KR | 20200056916 | A | * | 5/2020 | F28F 21/085 |
| TW | M563536 | U | | 7/2018 | |
| TW | M622344 | U | | 1/2022 | |

* cited by examiner

VAPOR CHAMBER SUPPORTING CAPILLARY STRUCTURE

BACKGROUND

Technical Field

The present disclosure relates to a heat exchange element, and in particular, to a vapor chamber supporting capillary structure.

Description of Related Art

Vapor chamber is a common heat exchange element nowadays, and it is widely applied to various fields, such as cooling or heat transfer. It utilizes a working fluid sealed and stored inside to perform phase change, in order to perform heat transfer swiftly, such that its heat transfer or cooling effect can be increased.

However, as electronic products to which vapor chambers are applied are demanded to have light weight and compact size, the thickness of vapor chamber must also be reduced accordingly. Under such condition, the capillary structure inside the vapor chamber for return of the working fluid continues to expand and occupies the entire chamber, such that the delivery of the vaporized working fluid is affected, and eventually, the heat transfer is hindered.

In view of the above, the inventor seeks to improve and overcome the aforementioned drawbacks and proposes a reasonable design capable of effectively improving the aforementioned drawbacks after extensive research along with the utilization of academic principles.

SUMMARY

A primary objective of the present disclosure is to provide a vapor chamber supporting capillary structure, and it is able to utilize the configuration of the capillary and supporting structures formed inside the vapor chamber to obtain a greater steam space to accommodate the vaporized working fluid, thereby increasing the heat transfer efficiency.

Furthermore, another objective of the present disclosure is to provide a vapor chamber supporting capillary structure, and it is able to reduce the path required for the working fluid to undergo vapor-liquid phase change, thereby facilitating both the heat and mass transfer effects.

To achieve the aforementioned objectives, the present disclosure provides a vapor chamber supporting capillary structure having a first plate, a second plate and a capillary layer. The first plate includes a first inner surface. The second plate includes a second inner surface and facing toward the first inner surface for attaching to each other. In addition, a chamber is arranged between the first plate and the second plate.

The capillary layer is clamped between the first plate and the second plate and is located inside the chamber, and the capillary layer includes at least a first capillary portion and a second capillary portion. The second capillary portion is connected to the first capillary portion and extends outward, and a notch is formed at any one side of the second capillary portion. The notch is formed along an extension direction of the second capillary portion. Furthermore, the first plate includes a plurality of capillary supporting structures and a plurality of plate supporting structures formed on the first surface, and the plurality capillary supporting structures at least correspond to the first capillary portion and the second capillary portion, and the plurality of plate supporting structures correspond to the notch of the capillary layer.

DETAILED DESCRIPTION

The technical content of this disclosure will become apparent with the detailed description of embodiments accompanied with the illustration of related drawings as follows. It is intended that the embodiments and drawings disclosed herein are to be considered illustrative rather than restrictive.

Figure 1:
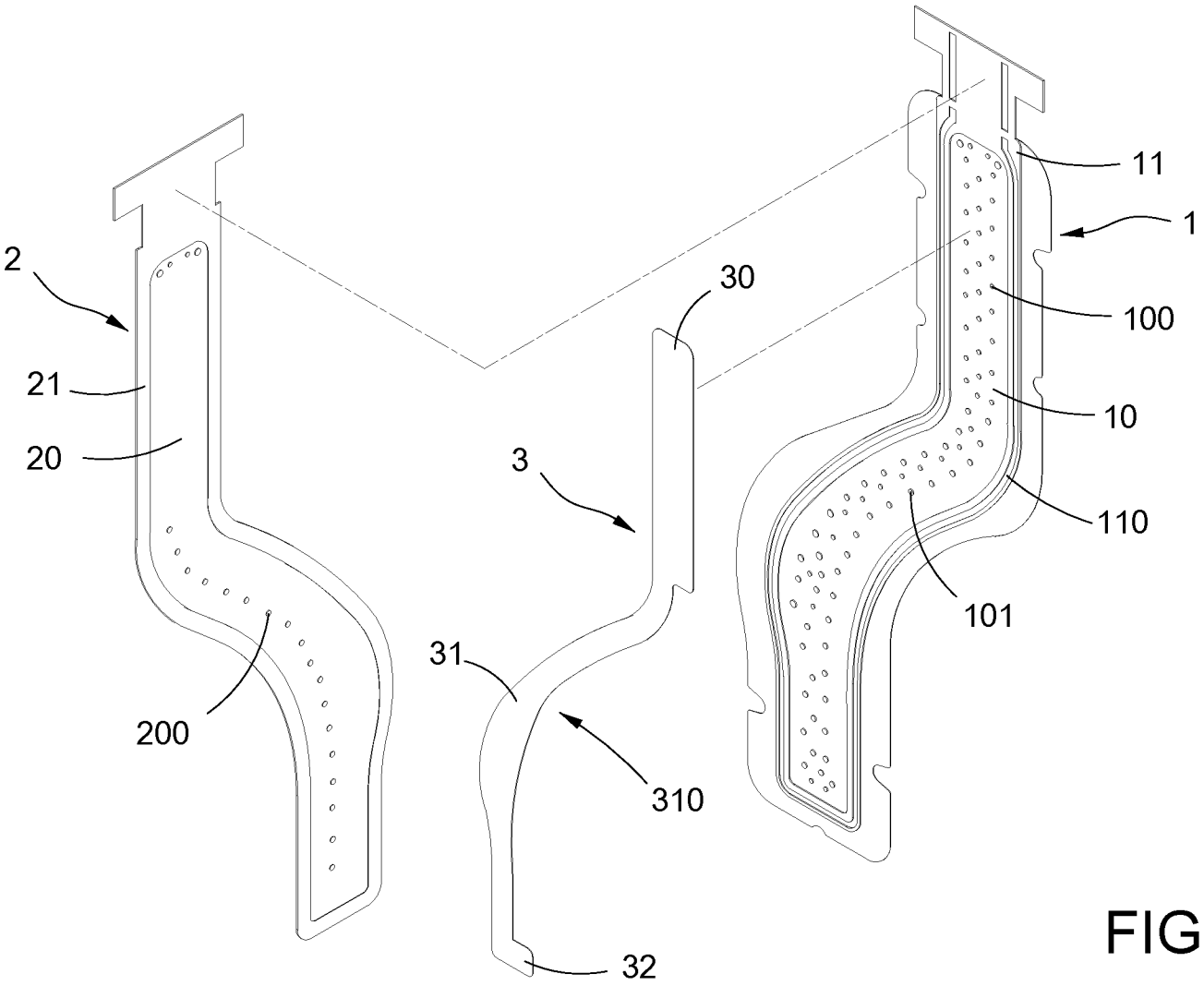
FIG. 1 is a perspective exploded view according to the first exemplary embodiment of the present disclosure.
Figure 2:
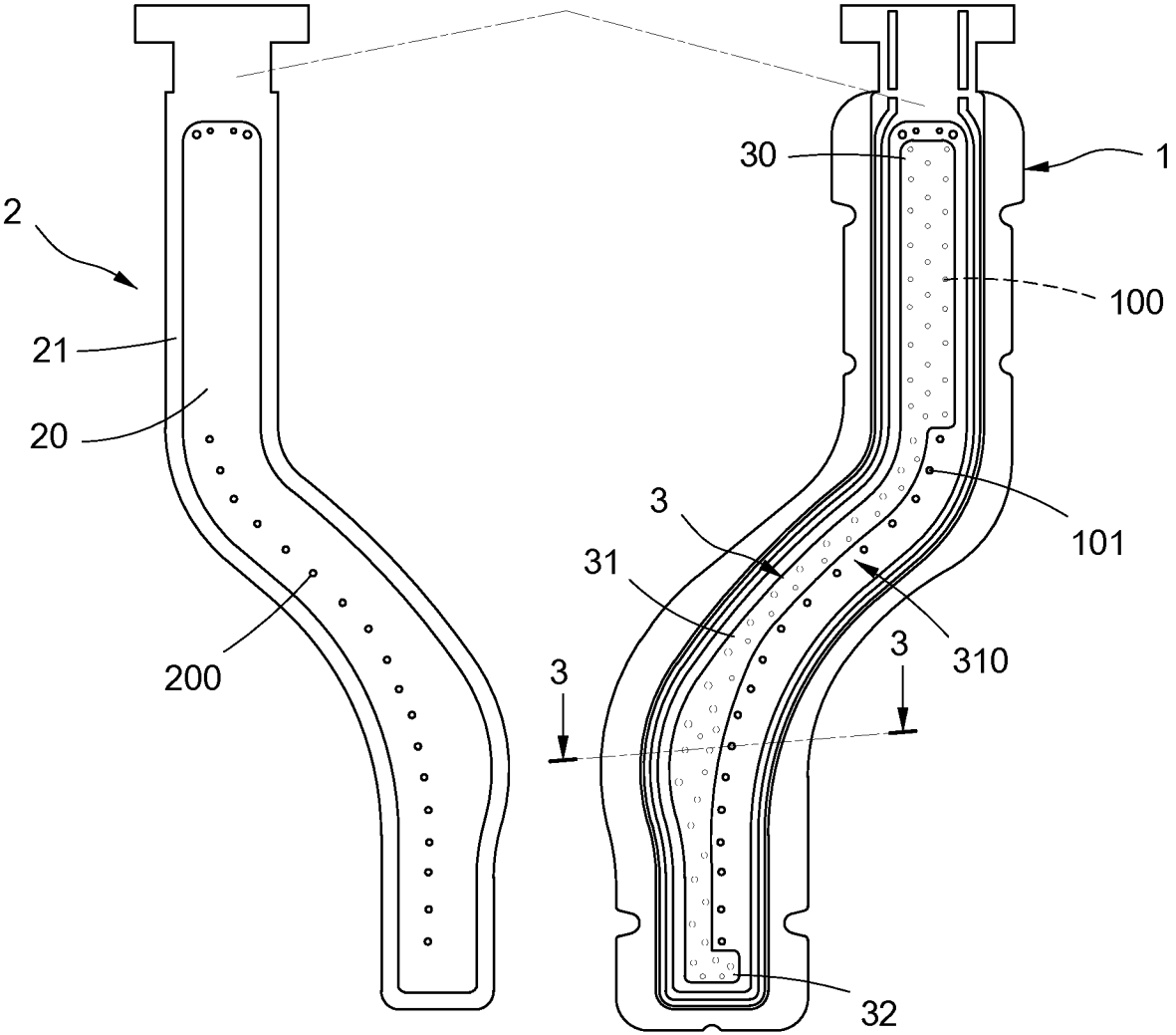
FIG. 2 is a plane expanded view according to the first exemplary embodiment of the present disclosure.

Please refer to FIG. 1 and FIG. 2, showing a perspective exploded view and a plane expanded view according to a first exemplary embodiment of the present disclosure respectively. The present disclosure provides a vapor chamber supporting capillary structure having a first plate 1, a second plate 2, and a capillary layer 3.

Figure 3:
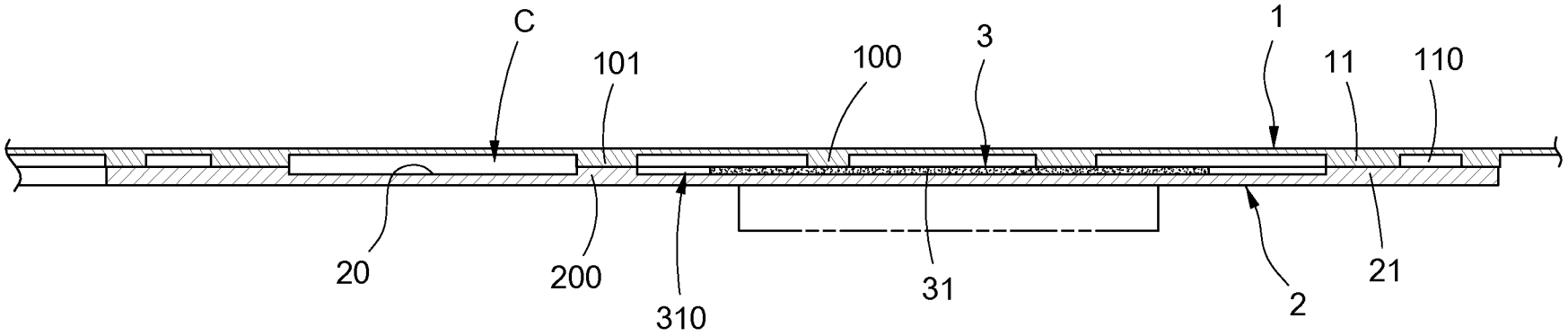
FIG. 3 is a cross-sectional view of FIG. 2 taken along line 3-3.
Figure 4:
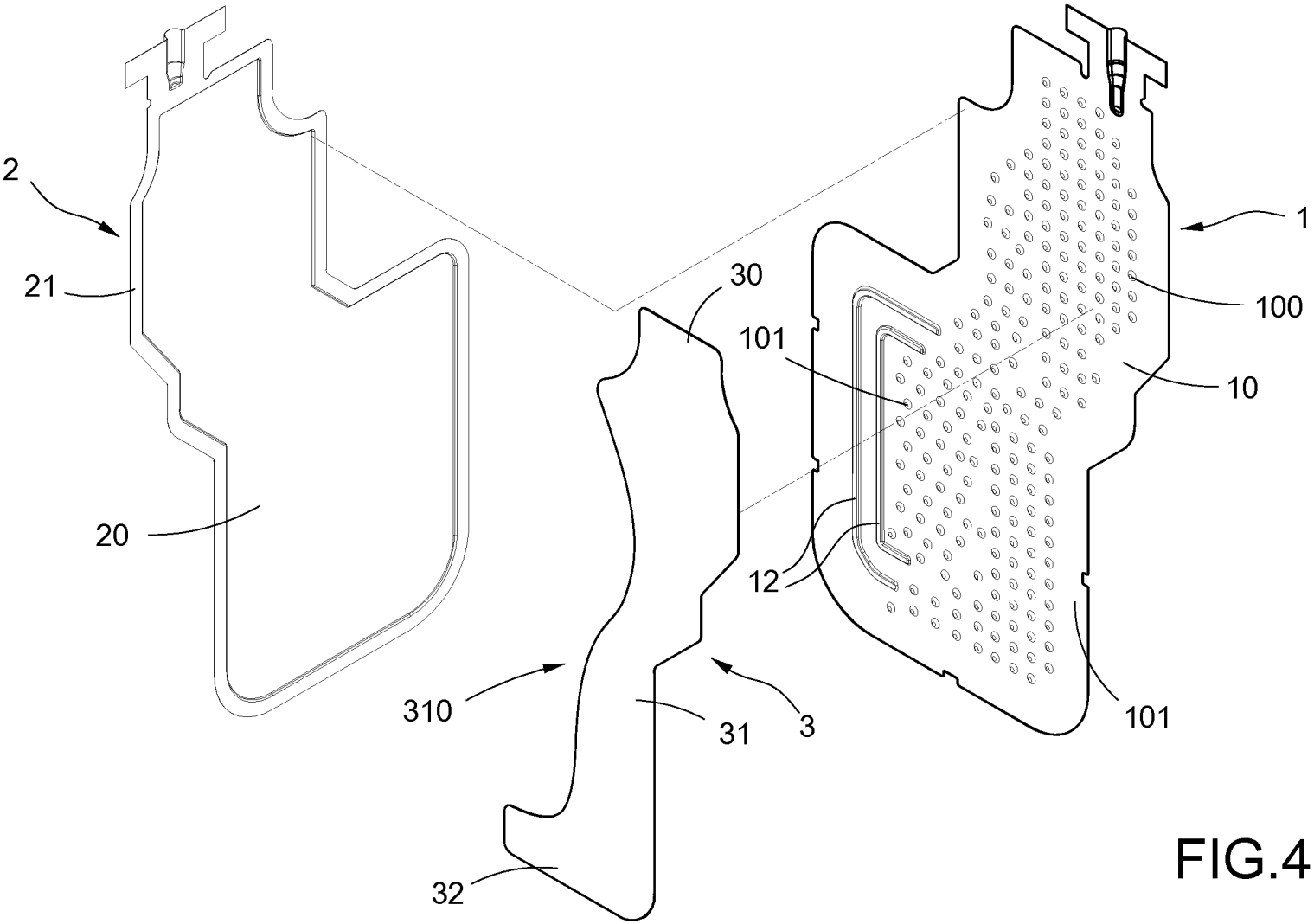
FIG. 4 is a perspective exploded view according to the second exemplary embodiment of the present disclosure.

The first plate 1 and the second plate 2 are attached to each other, and a chamber C (as shown in FIG. 3) is formed between the first and second plates 1, 2. In the exemplary embodiment of the present disclosure, the first plate 1 includes a first inner surface 10 facing the second plate 2. The second plate 2 includes a second inner surface 20 facing the first plate 1 or the first inner surface 10. The chamber C is formed between the first inner surface 10 and the second inner surface 20. To be more specific, in the first exemplary embodiment of the present disclosure, the first inner surface 10 of the first plate 1 and the second inner surface 20 of the second plate 2 respectively are in a recessed shape to jointly form the chamber C. Alternatively, one of the first and second inner surfaces 10, 20 may be in a recessed shape and the other one is in a flat shape to cover correspondingly for sealing the chamber C, such as the second exemplary embodiment of the present disclosure, as shown in FIG. 4.

According to the above, the first plate 1 may further include a first sealing edge 11 surrounding an exterior of the first inner surface 10, and the second plate 2 includes a second sealing edge 21 surrounding an exterior of the second inner surface 20. In addition, when the first plate 1 and the second plate 2 cover each other, the first sealing edge 11 and the second sealing edge 21 are attached to each other to be sealed via a manufacturing process, such as welding, to accommodate and seal an appropriate amount of working fluid (not shown in the drawings) inside the chamber C. In addition, as shown in FIG. 3, the first sealing edge 11 may protrude from the first inner surface 10, and the second sealing edge 21 may protrude from the second inner surface 21. In another feasible exemplary embodiment, only one of the first plate 1 and the second plate 2 may have the first sealing edge 11 or the second sealing edge 21 while the other one is in a flat shape for covering correspondingly. As shown in FIG. 4, the second plate 2 includes the second sealing edge 21, and the first plate 1 is in a flat shape for covering correspondingly. Furthermore, the first sealing edge 11 (as shown in FIG. 1) or the second sealing edge 21 (not shown in the drawings) may have a filling slot 110, in order to facilitate the filling of welding material during the aforementioned manufacturing process of welding.

Please refer to FIG. 1 to FIG. 3. The capillary layer 3 may be made of a metal knitted mesh or may be made of sintered powder, and it can be clamped inside the chamber C between the first and second plates 1, 2. In addition, the capillary layer 3 includes a first capillary portion 30, a second capillary portion 31 and a third capillary portion 32. The first capillary portion 30 and the third capillary portion 32 are respectively located at two distal ends away from each other inside the chamber C. The second capillary portion 31 is connected between the first capillary portion 30 and the third capillary portion 32. To be more specific, the first capillary portion 30 is arranged at the heated portion of the vapor chamber, and the third capillary portion 32 is arranged at the condensation portion of the vapor chamber. In addition, the second capillary portion 31 extends from the first capillary portion 30 to the third capillary portion 32 to be integrally connected. Furthermore, the width of the second capillary portion 31 is at least smaller than the first capillary portion 30, or may further be smaller than the third capillary portion 32. A notch 310 is formed at any one side of the second capillary portion 31, and the notch 310 is formed along an extension direction of the second capillary portion 31.

As shown in FIG. 2 and FIG. 3, the first plate 1 includes a plurality of capillary supporting structures 100 and a plurality of plate supporting structures 101 formed on the first inner surface 10. Each one of the capillary supporting structures 100 and the plate supporting structures 101 may be protrusions with a column shape formed on the first inner surface 10, and the capillary supporting structures 100 are at least corresponding to the first capillary portion 30 and the second capillary portion 31 of the capillary layer 3. The capillary supporting structures 100 may further be formed corresponding to the third capillary portion 32. The plate supporting structures 101 is corresponding to the notch 310 of the capillary layer 3 to allow the capillary supporting structures 100 to support the capillary layer 3 to abut against the second inner surface 20 of the second plate 2. Furthermore, the plate supporting structures 101 abut against a plurality of attachment supporting structures 200 formed on the second inner surface 20 of the second plate 2, or may directly abut against the second inner surface 20.

Accordingly, with the aforementioned structure construction, the vapor chamber supporting capillary structure of the present disclosure may be achieved.

Please refer to FIG. 2 and FIG. 3. When the vapor chamber uses the first capillary portion 30 as the heated portion to contact with a heat generating element (not shown in the drawings), after the working fluid stored therein undergoes vaporization to become steam, it is able to pass through the space on top of the capillary layer 3 inside the chamber C and moves toward the third capillary portion 32. In addition, when it passes through the top of the second capillary portion 31, since one side of the second capillary portion 31 is formed with the notch 310, the space for accommodating the steam is increased. As a result, the thermal conduction efficiency of the steam may be increased to allow the steam to reach the condensation portion faster to perform cooling. Furthermore, the formation of the notch 310 is able to reduce the path required for the working fluid to undergo vapor-liquid phase change, thereby facilitating both the heat and mass transfer effects.

Figure 5:
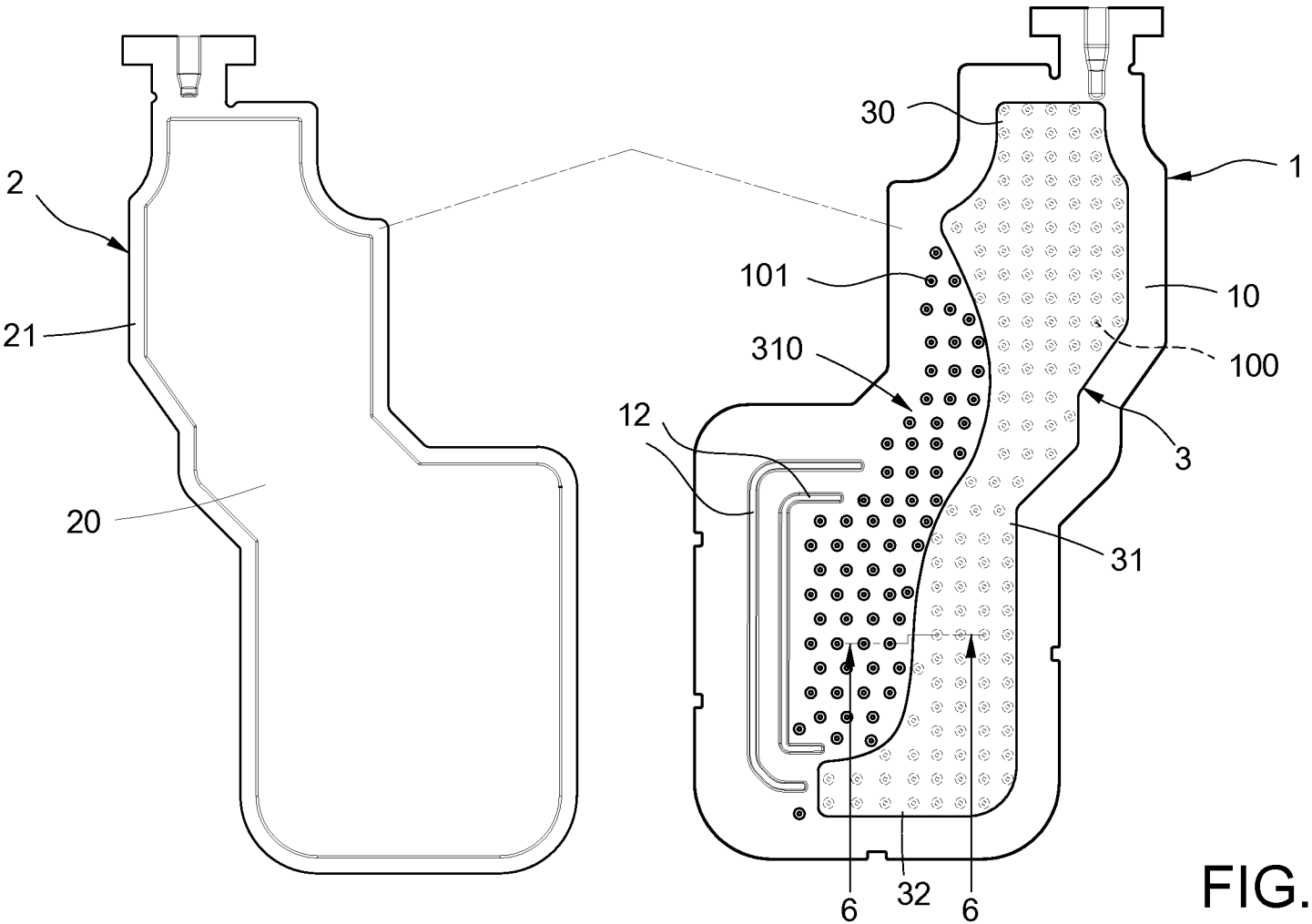
FIG. 5 is a plane expanded view according to the second exemplary embodiment of the present disclosure.
Figure 6:
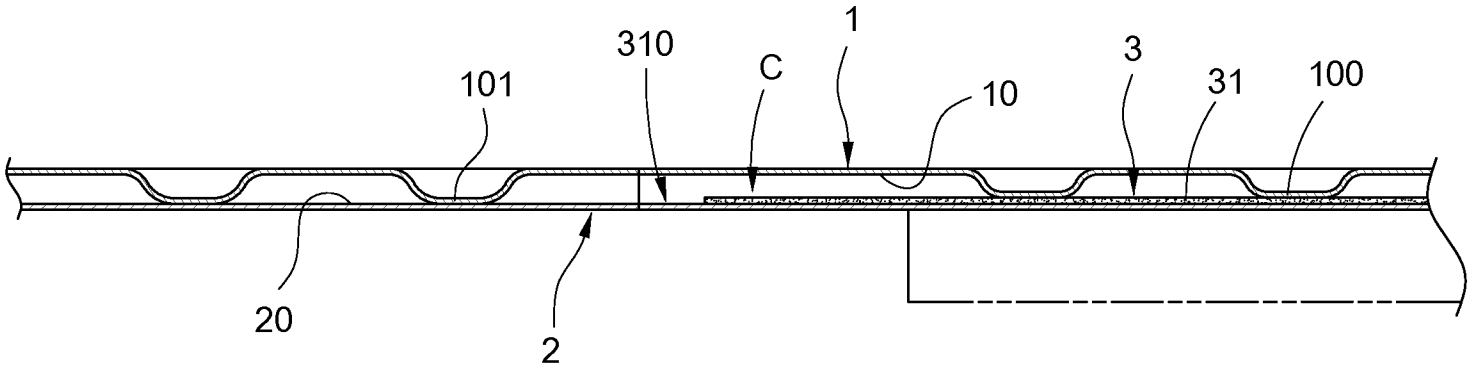
FIG. 6 is a cross-sectional view of FIG. 5 taken along line 6-6.

In addition, as shown in FIG. 4 to FIG. 6. In the second exemplary embodiment of the present disclosure, a plurality of strip-type supporting structures 12 may be further formed on the first inner surface 10 of the first plate 1 and arranged spaced apart from each other. The plurality of strip-type supporting structures 12 are also corresponding to the notch 310 of the capillary layer 3 and partially surround the outer side of the plate supporting structures 101 to form a channel between any two adjacent strip-type supporting structures 12 and to allow the steam to flow therethrough. Furthermore, the steam may be guided to flow from the outer side of the plate supporting structures 101 back to the third capillary portion 32 of the capillary layer 3 via the channel to perform cooling, such that it is beneficial to utilize the increased steam space for steam delivery to achieve the effect of cooling.

Moreover, as shown in FIG. 6, the capillary supporting structures 100 and the plate supporting structures 101 may also be formed by indenting the outer side surface of the first plate 1 toward the first inner surface 10. In other words, the capillary supporting structures 100 and the plate supporting structures 101 may not be limited to the exemplary embodiments illustrated by the present disclosure.

In view of the above, the present disclosure is able to achieve the expected purpose of use and to overcome known drawbacks. In addition, the present disclosure is of novelty and inventive step such that it complies with the patentability requirement. Accordingly, an application is hereby filed according to the Patent Act, and the grant of the patent right of the present application is sought with respect to the protection of the rights of the inventor.

The above description is provided to illustrate the exemplary embodiments of the present disclosure only such that it shall not be treated as limitation to the claimed scope of the present disclosure. In addition, any equivalent modification made based on the present disclosure shall be considered to be within the claimed scope of the present disclosure.

What is claimed is:

1. A vapor chamber supporting capillary structure, comprising:

a first plate, comprising a first inner surface and a first sealing edge surrounding the first inner surface;

a second plate, comprising a second inner surface facing the first inner surface and a second sealing edge surrounding the second inner surface, covering the first plate with each other, and a chamber defined between the first plate and the second plate, wherein the first sealing edge and the second sealing edge are attached to each other to seal the chamber, and the first sealing edge or the second sealing edge has a filling slot in order to facilitate filling of welding material during a manufacturing process of welding; and a capillary layer, clamped between the first plate and the second plate to be located inside the chamber, at least comprising a first capillary portion and a second capillary portion, the second capillary portion connected to the first capillary portion and extended outward, a notch defined at any one side of the second capillary portion, and the notch defined along an extension direction of the second capillary portion;

wherein the first plate comprises a plurality of capillary supporting structures and a plurality of plate supporting structures disposed on the first inner surface, the plurality capillary supporting structures are at least corresponding to the first capillary portion and the second capillary portion, and the plurality of plate supporting structures are corresponding to the notch of the capillary layer;

wherein the capillary layer further comprises a third capillary portion, and the second capillary portion is connected between the first capillary portion and the third capillary portion, wherein the second capillary portion is bent to cause the first capillary portion and the third capillary portion at both ends of the second capillary portion to be arranged in a staggered manner;

wherein the first plate and the second plate comprise a bending area corresponding to the second capillary portion, the plurality of capillary supporting structures and the plurality of plate supporting structures are protrusions with a column shape, wherein the shape and pattern of the plurality of capillary supporting structures and the plurality of plate supporting structures disposed in the bending area are same as the shape and pattern of the plurality of capillary supporting structures and the plurality of plate supporting structures disposed outside the bending area.

2. The vapor chamber supporting capillary structure according to claim 1, wherein the first inner surface of the first plate and the second inner surface of the second plate are respectively in a recessed shape to jointly define the chamber.

3. The vapor chamber supporting capillary structure according to claim 1, wherein the second plate comprises a plurality of attachment supporting structures disposed on the second inner surface, and the plurality of attachment supporting structures are protrusions with a column shape and abut against the plurality of plate supporting structures.

4. The vapor chamber supporting capillary structure according to claim 1, wherein a width of the second capillary portion is smaller than a width of the first capillary portion.

5. The vapor chamber supporting capillary structure according to claim 1, wherein the first capillary portion and the third capillary portion are respectively located at two distal ends away from each other inside the chamber.

6. The vapor chamber supporting capillary structure according to claim 1, wherein a width of the second capillary portion is smaller than a width of the first capillary portion and a width of the third capillary portion.

* * * * *